US005454313A

United States Patent [19]

Jenkins

[11] Patent Number: 5,454,313

[45] Date of Patent: Oct. 3, 1995

[54] RETROFIT VARIABLE SPEED DAMPENING APPARATUS FOR PRINTING PRESS

[76] Inventor: W. Allan Jenkins, 1 Haliburton Ave., Toronto, Ontario, Canada, M9B 4Y1

[21] Appl. No.: 376,979

[22] Filed: Jan. 23, 1995

[51] Int. Cl.[6] ..... B41F 31/13; B41L 27/08

[52] U.S. Cl. ..... 101/350

[58] Field of Search ..... 101/349, 350, 101/351, 352, 363, 148, 207–210, 355, 356, 357, 360, 361, 363

[56] References Cited

U.S. PATENT DOCUMENTS 2,285,052 6/1942 Roesen ..... 101/350
3,170,397 2/1965 Dutro et al. ..... 101/350

*Primary Examiner*—J. Reed Fisher

*Attorney, Agent, or Firm*—Barrigar & Moss

[57] ABSTRACT

A variable speed transmission apparatus is disclosed for controlling the rotational speed of a fountain roller in an offset printing press. The apparatus includes a mounting plate adapted to be mounted about the shaft of the fountain roller. A screw mechanism is mounted on the mounting plate and has a sliding block or nut for controlling the position of a first link of a two-bar linkage having a common pivot axis connected to a reciprocating drive in the printing press. The second link of the two-bar linkage is pivotally coupled to oscillate a drive crank with a one-way bearing mounted on the fountain roller shaft. Changing the position of the first bar of the two-bar linkage gives infinitely variable adjustment of the oscillating motion of the crank and thus the rotation of the fountain roller. All of the components being mounted relative to a single mounting plate, the apparatus can be retrofitted to existing fountain roller equipment.

14 Claims, 7 Drawing Sheets

RETROFIT VARIABLE SPEED DAMPENING APPARATUS FOR PRINTING PRESS

BACKGROUND OF THE INVENTION

1. Field of the Invention

This present invention relates to offset printing presses, and in particular to the water systems and to the control of the fountain rollers in these presses.

2. Description of the Prior Art

In offset printing presses, water is applied to a printing plate before the ink is applied to cause the ink to adhere only to the image portion of the plate as is well known in the offset printing art. If too much water is applied to the printing plate, the ink washes out, and if not enough water is applied, too much ink adheres to the printing plate and scumming or streaking appears on the printed product.

Water is usually applied to the printing plate through a series of rollers. A first, fountain roller is located in a tray of water and rotates to pick up the water. A ductor or metering roller contacts the fountain roller to transfer the water thereon to a transfer roller. The transfer roller is in contact with an oscillator roller which oscillates longitudinally to even out the water. The water is then transferred to a water form roller which is in contact with the printing plate on a printing cylinder to evenly coat the printing plate with the desired amount of water.

The key to the amount of water ultimately applied to the printing plate is the speed or amount of rotation of the fountain roller before the water is transferred therefrom through the ductor or metering roller to the transfer roller. In the past, the rotation of the fountain roller has been controlled by a ratchet mechanism whereby a toothed wheel or gear is mounted on the shaft of the fountain roller, and a reciprocating pawl device engages a selected number of teeth on the wheel to rotate the fountain roller an incremental amount representing the amount of water desired to be picked up by the fountain roller and transferred through the ductor or metering roller to the transfer roller.

A difficulty with the prior art apparatus, however, is that it is not possible to obtain a fine enough adjustment of the movement of the fountain roller using a ratchet and pawl mechanism. If the teeth are made too small allowing for finer adjustment, the teeth are prone to excessive wear or breakage and premature failure of the apparatus.

Attempts have been made to replace the ratchet and pawl mechanism in the prior art with other devices for controlling the rotation of the fountain roller. One example of this is the use of an electric drive, such as a stepping motor to drive the fountain roller. Other approaches have used various machine elements involving cams and linkages. A difficulty with the prior art devices however, is that the printing presses or color heads have to be custom designed or made especially to incorporate these different types of mechanisms. It has generally not been possible to retrofit an existing printing press or color head with a different type of fountain roller drive due to the complexity of these machines and the limitations caused by lack of space and the presence of other equipment.

SUMMARY OF THE INVENTION

The present invention is a retrofit variable speed transmission or drive for a fountain roller where all of the components are mounted on or associated with a single mounting plate for easy assembly in existing machines.

According to the invention, there is provided a transmission apparatus for controlling the rotation of a fountain roller in an offset printing press, the printing press having a housing containing a reciprocating drive and the fountain roller having a shaft extending into the housing. The apparatus comprises a mounting plate adapted to be mounted in the printing press housing adjacent to the shaft of the fountain roller. A one-way rotational clutch is adapted to be mounted on the fountain roller shaft. A crank is operably connected to the clutch for rotation of the clutch and thus the shaft. A drive link is pivotally connected to the crank for rotation of the crank upon longitudinal movement of the drive link transversely of the crank. The drive link has a remote distal end adapted to be pivotally coupled to the reciprocating drive. Also control means are mounted on the mounting plate and adapted to be coupled to the reciprocating drive for controlling the direction of movement of the reciprocating drive relative to the drive link.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
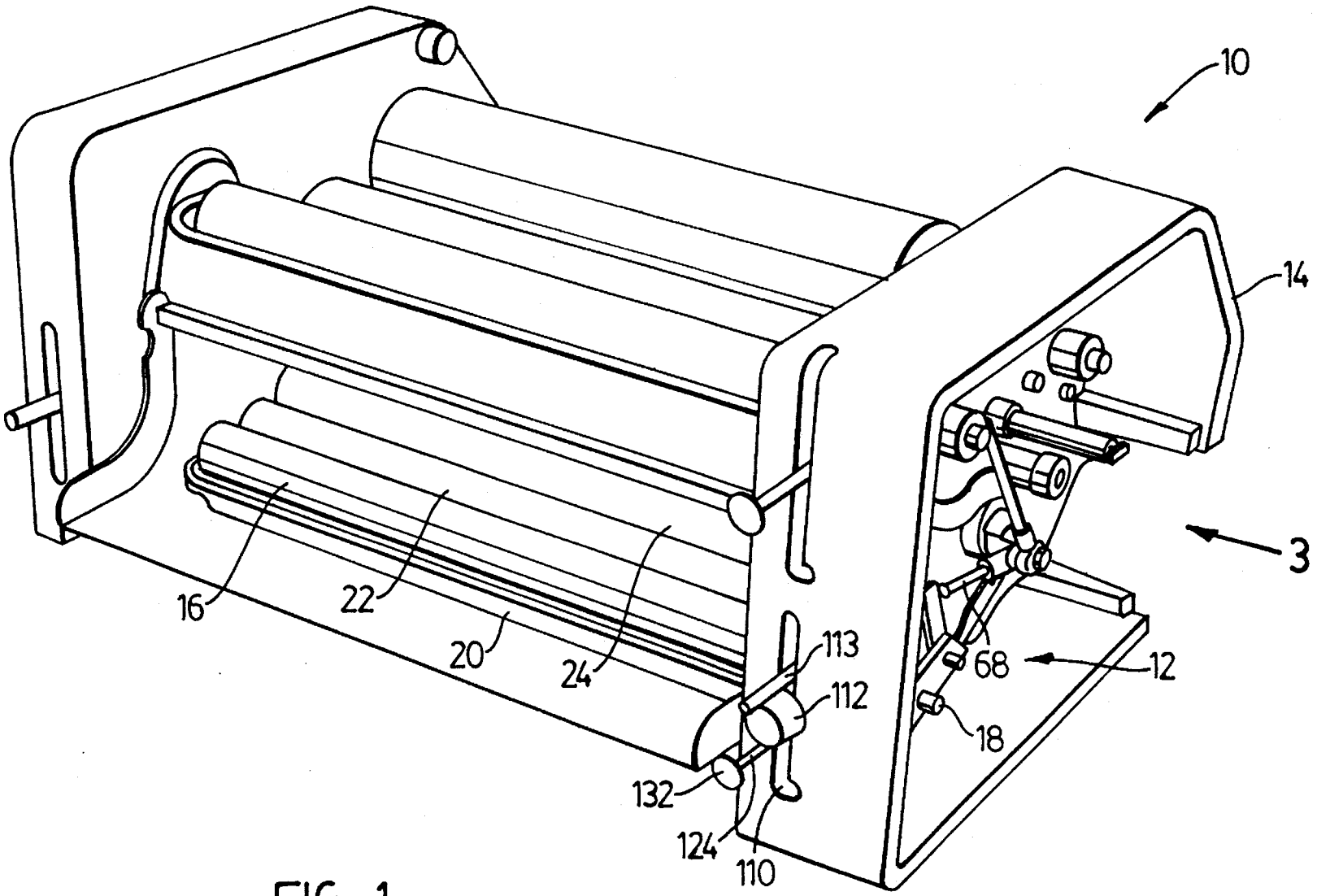
FIG. 1 is a perspective view of a portion of an offset printing press, being a color head, with the cover of the drive housing removed, showing a preferred embodiment of the present invention installed therein.

Referring firstly to FIG. 1, a typical color head for an offset printing press is generally indicated by reference numeral 10. A preferred embodiment of a transmission apparatus according to the present invention is generally indicated by reference numeral 12 and is mounted in a housing 14 of color head 10. Although transmission apparatus 12 is shown mounted in a color head 10, which normally is a detachable device for an offset printing press, transmission apparatus 12 could be mounted in the press itself if the press were a single color press without a separate color head. Such a press has an integral dampening system. For the purposes of this disclosure, the term "printing press", is intended to include both the press itself and a separate color head. In either case, the dampening system in question usually has a fountain roller 16 having a drive shaft 18 projecting into housing 14. Fountain roller 16 is mounted for rotation in a water tray 20 to pick up water as it rotates. The water thus picked up is transferred to a metering or ductor roller 22. If it is a metering roller, it is in constant contact with fountain roller 16 and a transfer roller 24 to transfer the water picked up by fountain roller 16 to transfer roller 24. If it is a ductor roller, roller 22 swings back and forth, first contacting fountain roller 26 to pick up water and then moving over to engage transfer roller 24 to transfer the water that is picked up, to transfer roller 24. The color head described herein employs a ductor roller, but the present invention is applicable to either the ductor roller or metering roller type of apparatus. Neither the offset printing press itself nor the color head 10 is considered to be part of the present invention, so will not be described in further detail herein.

Figure 2:
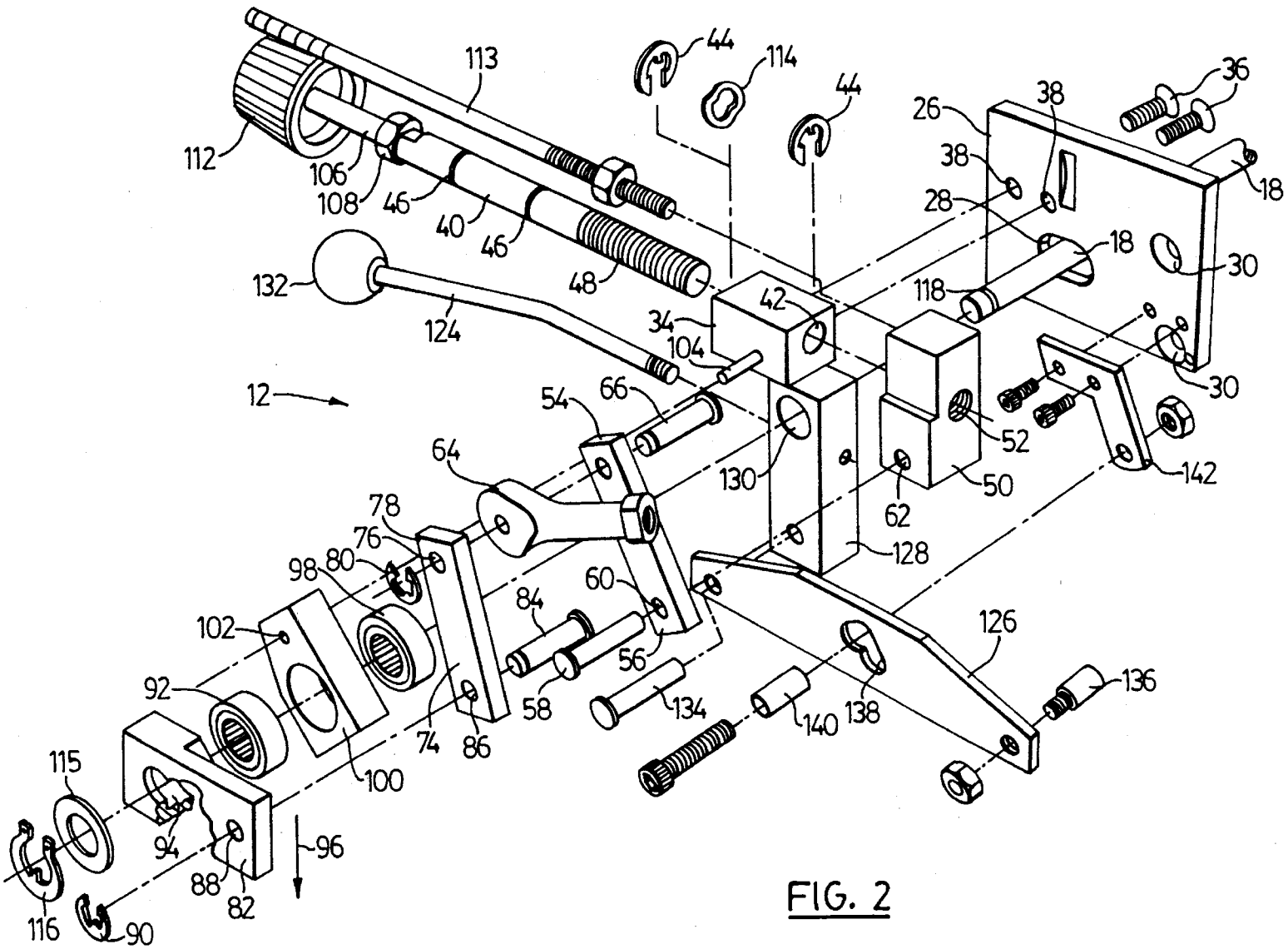
FIG. 2 is an exploded perspective view of a preferred embodiment of the transmission apparatus of the present invention.

Referring next to FIG. 2, transmission apparatus 12 is shown in exploded view to be assembled and mounted around fountain roller shaft 18. Transmission apparatus 12 includes a mounting plate 26 having a centrally located, elongate opening 28 to accommodate and allow fountain roller shaft 18 to pass therethrough. Mounting plate 26 also has one or more countersunk mounting holes 30 formed therein for attaching mounting plate 26 to an inside wall 32 (see FIG. 3) of housing 14. Mounting holes 30 are located to register with existing threaded holes in housing 14 used to mount the pre-existing drive apparatus for fountain roller 16 before the transmission apparatus 12 is retrofitted into housing 14. Elongate opening 28 accommodates any misalignment of shaft 18 and any tolerance variations in the location of the mounting holes in housing 14 which register with mounting holes 30 in plate 26. Mounting plate 26 is attached to housing 14 using flat-headed bolts (not shown) in mounting holes 30.

A fixed block 34 is attached to mounting plate 26 by flat-headed bolts 36 passing through holes 38 to be threaded into fixed block 34.

An adjusting rod or screw 40 is rotatably mounted in fixed block 34 through opening 42 and is held in a stationary but rotatable position by snap rings 44 being located in annular grooves 46 in adjusting rod 40. Adjusting rod 40 has a threaded end portion 48 which is threaded into a nut or sliding block 50. Adjusting rod 40 is mounted to mounting plate 26 through fixed block 34, and sliding block 50 is located against and slides along mounting plate 26 as adjusting rod 40 is rotated, sliding block 50 being threadably mounted on threaded end portion 48 using threaded opening 52 in sliding block 50. Threaded rod or screw 40 and sliding block or nut 50 form a screw mechanism mounted on mounting plate 26 for controlling the position or location of one end of a control link 54. This one end is referred to as a remote distal end 56 and is pivotally coupled to sliding block 50 by a pin 58 passing through mating openings 60 and 62 in respective control link 54 and sliding block 50. Pin 58 could be either a shoulder bolt threaded into opening 62 or a plain pin press fitted into hole 62 or held in position by a split pin, etc.

The end of control link 54 opposite to remote distal end 56 is pivotally coupled to an eye coupling 64 by a pin 66. Eye coupling 64 is part of a reciprocating drive 68 (see FIGS. 3 and 4), which is eccentrically coupled through a second eye coupling 70 to a constantly rotating shaft 72. Reciprocating drive 68 is not part of the present invention, but is part of the pre-existing drive for the various rollers of color head 10.

A drive link 74 is also pivotally coupled to reciprocating drive eye coupling 64 and control link 54 by pin 66 passing through an opening 76 in a remote distal end 78 of drive link 74. A snap ring 80 holds pin 66 in place. The opposite end of drive link 74 is pivotally connected or coupled to a crank 82 by another pivot pin 84 passing through respective openings 86 and 88 in drive link 74 and crank 82. Pin 84 is held in position by a snap ring 90.

A one-way rotational clutch 92 is press fitted into an opening 94 in crank 82. One-way clutch 92 is a one-way roller bearing wherein the rollers are only permitted to turn in one direction. Thus, movement of crank 82 in the direction of arrow 96 causes shaft 18 to rotate clockwise as seen in FIG. 2 because the rollers of bearing 92 will not rotate in this direction, but movement of crank 82 in a direction opposite to arrow 96 just causes crank 82 to rotate about shaft 18 with no rotation of the shaft because the rollers of bearing 92 do rotate in this direction. To prevent shaft 18 from rotating counter clockwise, for example if one-way clutch or bearing 92 gets dirty, an anti-backlash, one-way, rotational clutch or bearing 98 is located on shaft 18 and press fitted into a floating crank 100. Floating crank 100 is connected to mounting plate 26 by being mounted on fixed block 34. Floating crank 100 has an opening 102 therethrough which fits loosely onto a pin 104 mounted in fixed block 34. This provides a loose fit allowing crank 100 to float to ensure that one-way bearings 92, 98 do not bind on shaft 18. It will be appreciated that one-way bearings 92, 98 are orientated the same. If bearing 92 is rotated clockwise, such as in the direction of arrow 96, the rollers in bearing 92 do not turn and thus shaft 18 has to rotate clockwise with the bearing. By the same token, if shaft 18 tries to rotate counter clockwise relative to anti-backlash bearing 98, the rollers in this bearing will not roll and shaft 18 will be prevented from rolling counter clockwise.

Referring again to adjusting rod 40, rod 40 includes an extension shaft 106 threaded into the end of the main rod 40 and held in position by a lock nut 108. Extension shaft 106 passes through a slot 110 in housing 14 (see FIG. 1), and since extension shaft 106 has an adjustment knob 112 mounted thereon which will not pass through slot 110, extension shaft 106 can be removed from adjusting rod 40 and reinserted from the outside of housing 14 through slot 110 during the installation of transmission apparatus 12. It will also be noted that a spring washer 114 is provided between one of the snap rings 44 and fixed block 34. This puts some tension on adjusting rod 40 and prevents it from rotating inadvertently.

An indicator rod 113 is threadably mounted in sliding block 50 to extend exteriorly of housing 14 adjacent to knob 112 to indicate the position of sliding block 50 and thus the remote distal end 56 of control link 54. This in turn indicates the amount of rotation being applied to fountain roller 16 and thus the amount of water being applied to a printing plate.

In order to prevent cranks 82, 100 from sliding off the end of shaft 18, a washer 115 and snap ring 116 are provided to fit over the end of shaft 18 with snap ring 116 fitting into an annular groove 118 in the end of shaft 18. If shaft 18 has no groove 118, then any other type of spring clip could be used in placeof snap ring 116.

Figure 3:
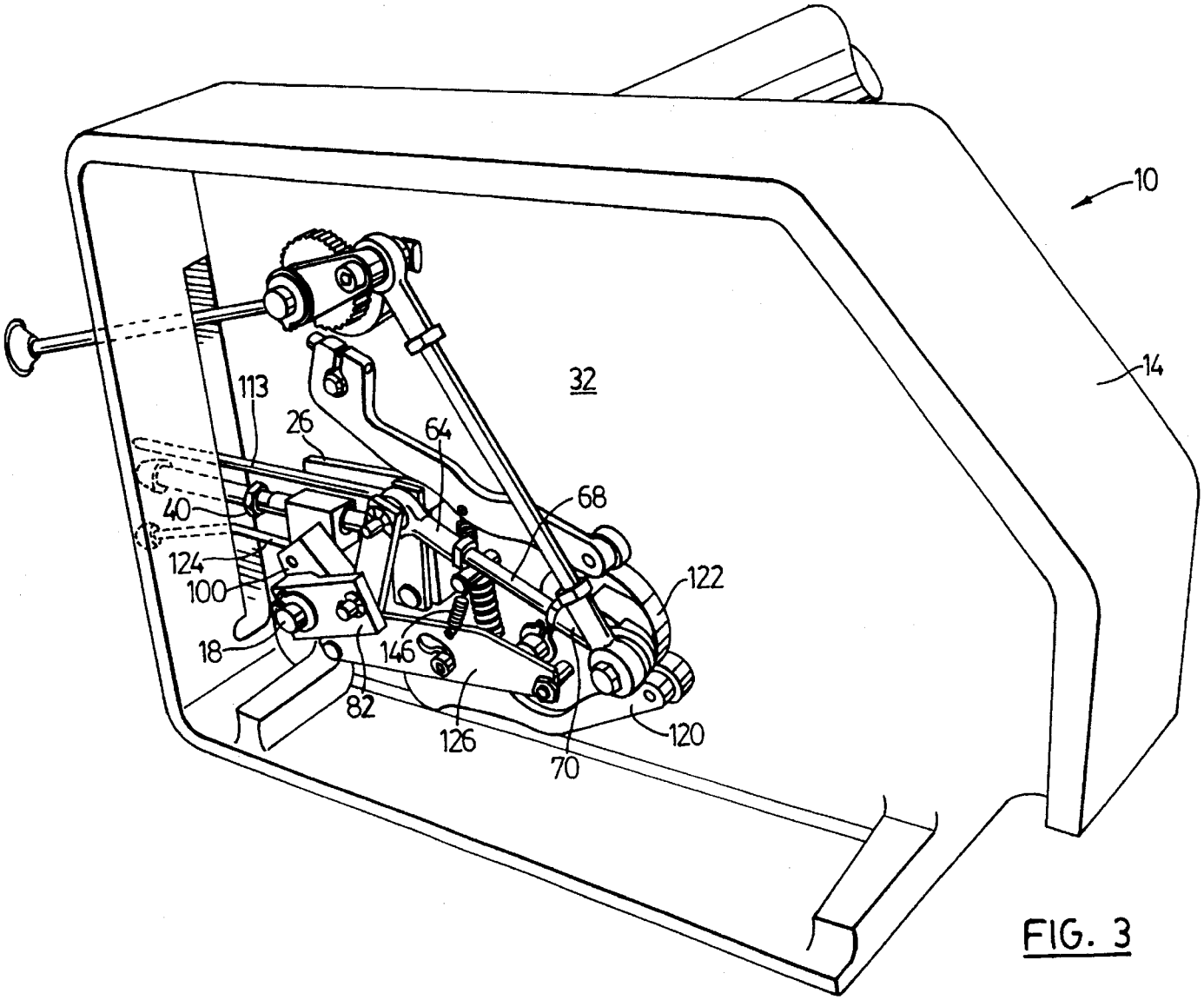
FIG. 3 is an enlarged perspective view taken in the direction of arrow 3 in FIG. 1.
Figure 4:
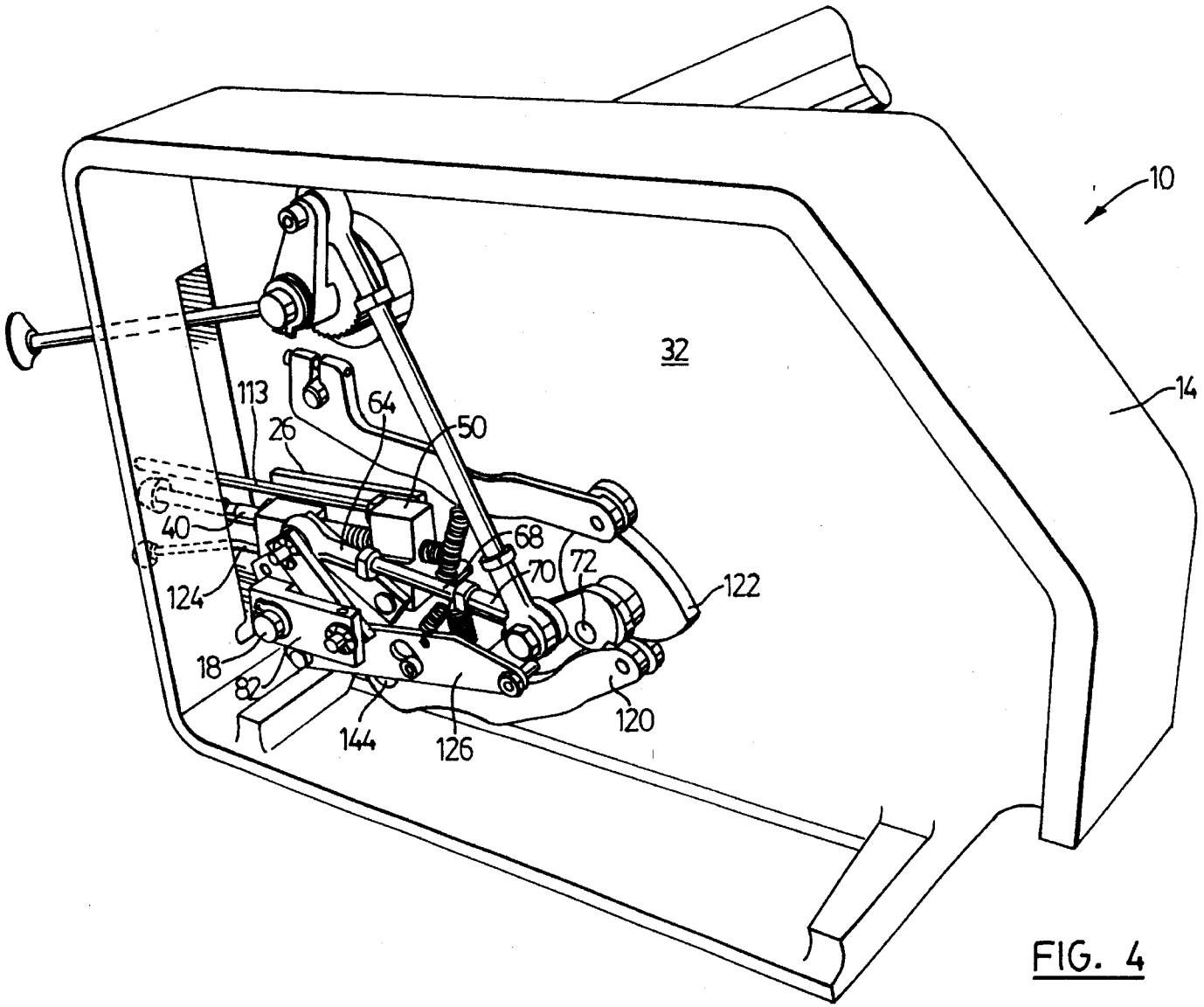
FIG. 4 is a perspective view similar to FIG. 3, but showing the transmission apparatus in a different position.

Referring again briefly again FIGS. 1, 3 and 4, ductor roller 22 is pivoted back and forth by a cam follower 120 attached to and extending radially from the shaft 144 (see FIGS. 7 and 8) of ductor roller 22. Cam follower 120 follows a cam 122 mounted on the same drive shaft that powers reciprocating drive 68. In order to quickly stop the operation of ductor roller 22, cam follower 120 is lifted off cam 122 by a release lever 124 operating a link 126 as described next with reference to FIGS. 2, 7 and 8.

Release lever 124 is pivotally mounted on mounting block 26 by being threaded into a pivoting block 128 rotatably mounted on shaft 18 through an opening 130 formed therein. As seen in FIG. 1, release lever 124 extends exteriorly of housing 14 and has a knob 132 secured to the end thereof, so it is most convenient for release lever 124 to be inserted through slot 110 and threaded into pivoting block 128. Link 126 is pivotally coupled to pivoting block 128 by a pivot pin 134. Link 126 has a transverse stud 136 formed on the end thereof to engage cam follower 120. Link 126 also has a central L-shaped opening 138 formed therein. A fulcrum or locking stud 140 is located in L-shaped opening 138 and is held in a fixed position by a bracket 142 mounted on mounting plate 26.

Figure 7:
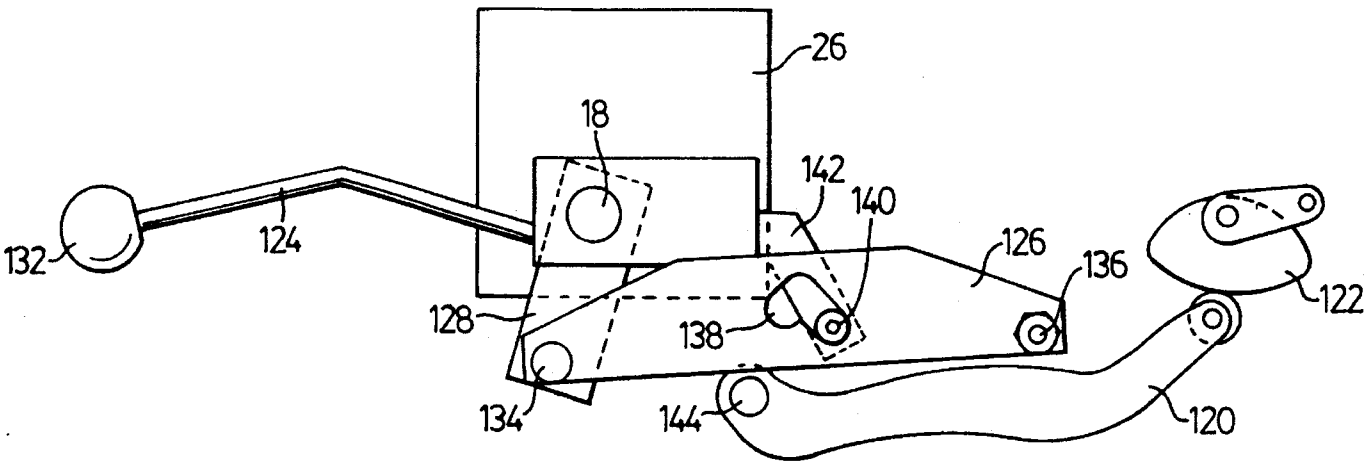
FIG. 7 is an elevational view of a portion of the apparatus of FIGS. 5 and 6 showing the release lever for the ductor roller, the lever being in the "off" position.
Figure 8:
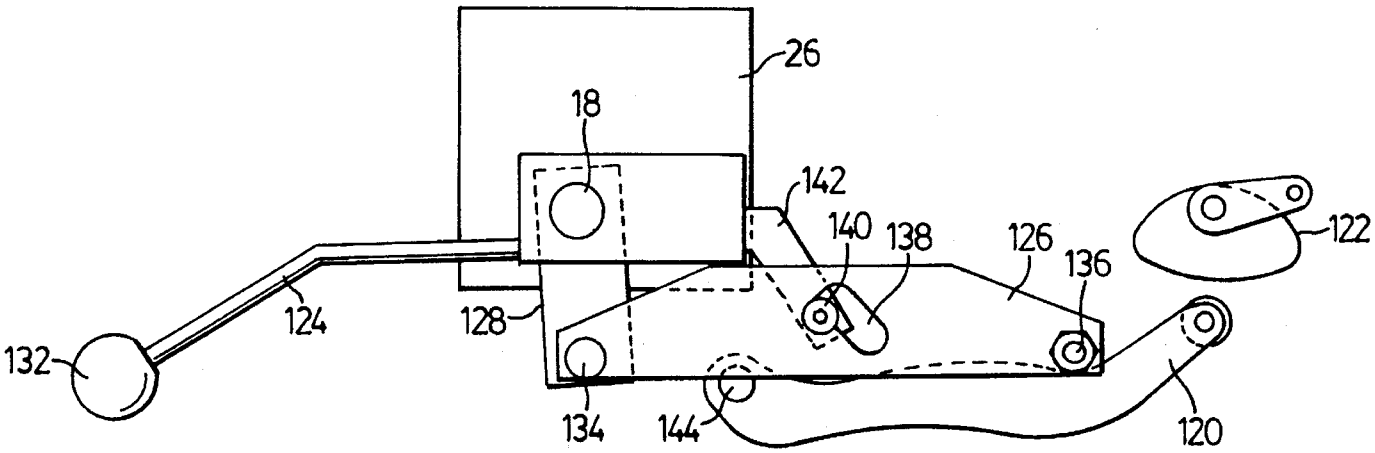
FIG. 8 is an elevational view similar to FIG. 7 showing the release lever in the "on" position where the ductor roller drive is disengaged.

As seen best in FIGS. 7 and 8, when release lever 124 is moved upwardly to an upper position, pivoting block 128 pivots clockwise and link 126 pivots counter clockwise about the fulcrum stud 140 causing stud 136 to disengage from cam follower 120 allowing cam follower 120 to engage cam 122 and make the ducting rolling pivot about its shaft 144. When release lever 124 is moved downwardly as in FIG. 8, pivoting block 128 pivots counter clockwise causing link 126 to pivot about fulcrum stud 140 causing stud 136 to move cam follower away from cam 122 stopping the operation of ductor roller 22. Opening 138, being L-shaped, locks release lever 124 in the release position as shown in FIG. 8, until a slight upper pressure on release lever 124 causes it to disengage, with the aid of a spring 146 as seen in FIG. 3.

The assembly of transmission apparatus 12 in color head 10 starts by removing indicator rod 113, extension shaft 106 and release lever 124, as well as all of the components outward of control link 54. The remaining assembly is then slid onto fountain roller shaft 18 and mounting plate 26 is attached to housing 14 with adjusting rod 40 extending outwardly through housing slot 110. Control link 54 and drive link 74 are then pivotally coupled to eye coupling 64 of the reciprocating drive 68. The remaining components are then slid onto shaft 18 and all appropriate snap rings are put into place to hold the assembly together. Indicator rod 113, extension shaft 106 and release lever 124 are then assembled through slot 110 in housing 14.

The operation of transmission apparatus will next be described with reference to FIGS. 5 and 6. In these figures, release lever 124 is shown in the downward position where release lever 126 disengages the ductor roller cam follower halting the operation of the ductor roller, but the operation of transmission apparatus is the same in respect of its rotational movement of fountain roller shaft 18 no matter what position release lever 124 is in. As long as reciprocating drive 68 continues to operate, transmission apparatus 12 continues to control the rotation of shaft 18.

Figure 5:
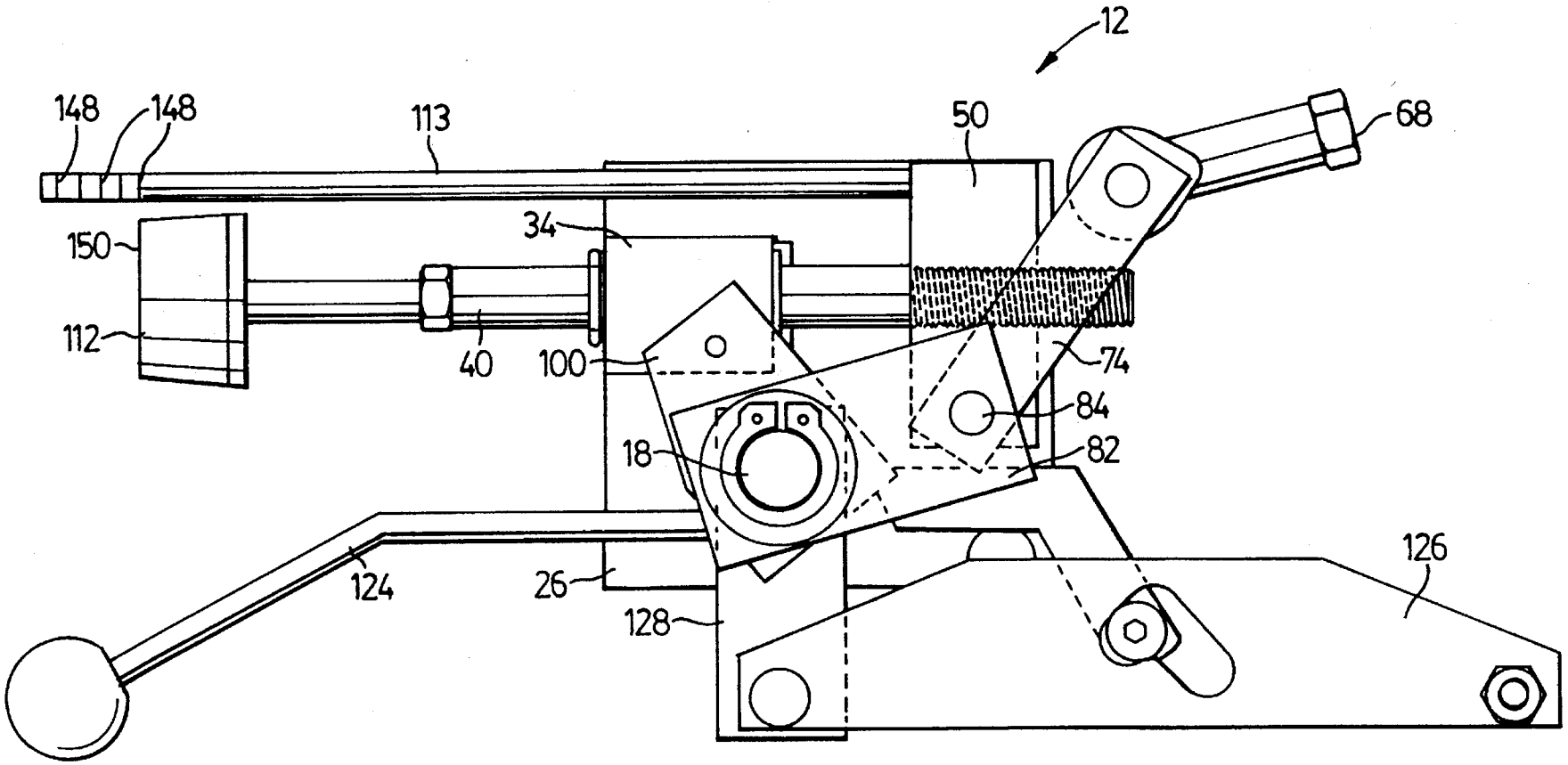
FIG. 5 is an elevational view of the transmission apparatus in a first position where there is no rotation of the fountain roller.
Figure 6:
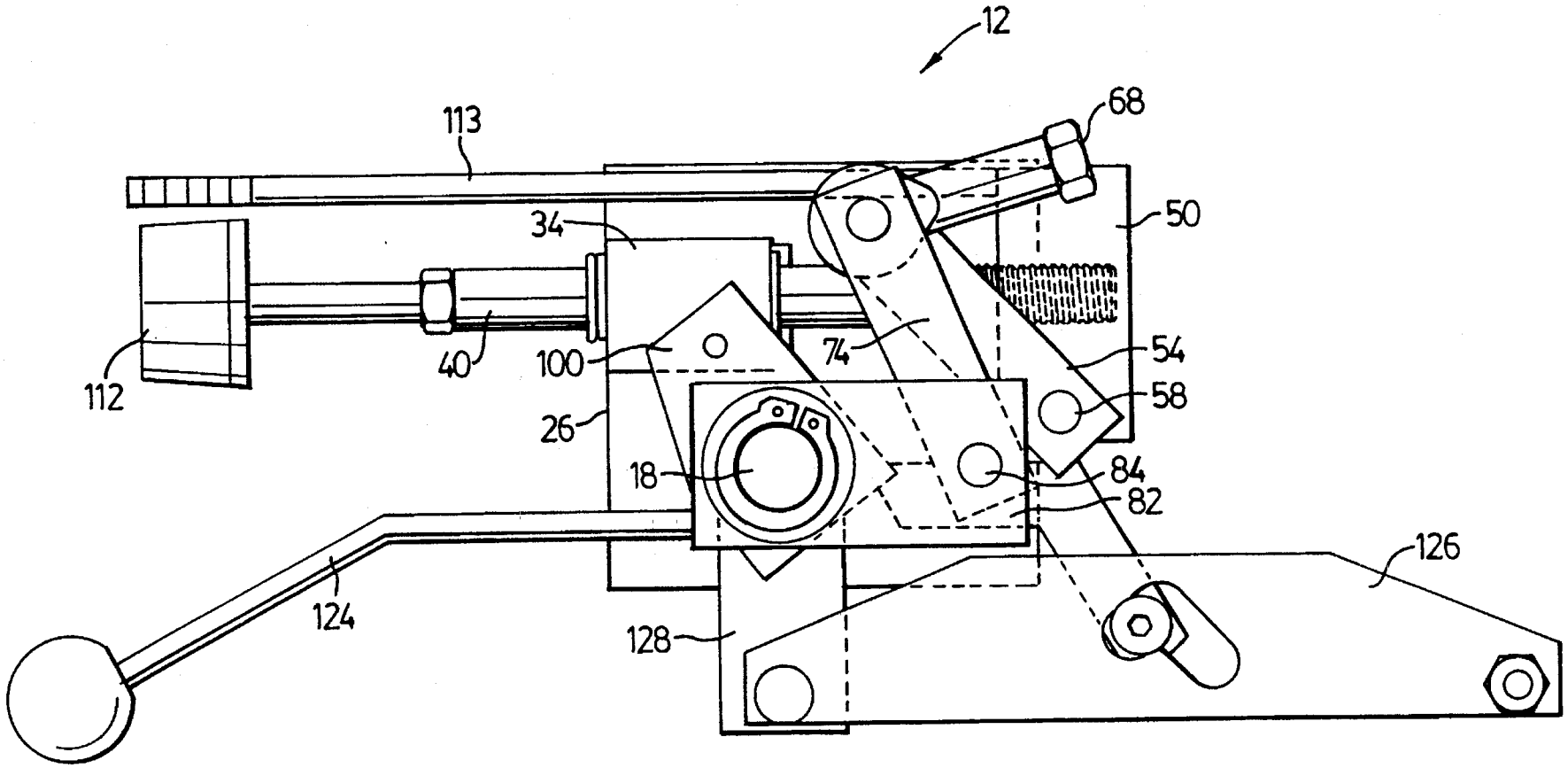
FIG. 6 is an elevational view similar to FIG. 5, but showing the apparatus in a second position where there is maximum rotation of the fountain roller.

In FIG. 5 adjusting knob 112 is turned fully clockwise causing sliding block 50 to move fully to the left toward fixed block 34. This causes control link 54 to align with drive link 74 and reciprocating movement of reciprocating drive 68 just causes these links to pivot about their lower pivot pins 58, 84. Crank 82 is not rotated and thus shaft 18 is not rotated. It will be noted that indicator rod 113 is fully extended causing its innermost distal marking 148 to be flush with the end face 150 of knob 112. This is the zero position or the position where no water is being picked up by fountain roller 16 and transferred to ductor roller 22. As adjustment knob 112 is turned counter clockwise, adjusting rod 40 rotates causing sliding block 50 to move to the right. This causes remote distal end 56 of control link 54 to move away from drive link 74 causing the lower ends of control link 54 and drive link 74 to separate. This changes the direction of movement of reciprocating drive 68 relative to drive link 74, moving it in a longitudinal attitude or direction, causing drive link 74 to move longitudinally, and since drive link 74 is disposed transversely of crank 82, crank 82 rotates causing shaft 18 to rotate. Actually, crank 82 oscillates up and down as viewed in FIG. 6 as reciprocating drive 68 moves back and forth. On the return stroke, of course, shaft 18 does not move due to the one-way rotational clutches 92, 98. Sliding block 50 and control link 54 thus form control means connected to reciprocating drive 68 to control the direction of movement of the reciprocating drive relative to drive link 74 causing zero longitudinal movement of drive link 74 as indicated in FIG. 5 or a maximum longitudinal movement as indicated in FIG. 6. Control link 54 moves from a first position, where the drive link and control link are parallel imparting no rotation to shaft 18, continuously through to a second position as indicated in FIG. 6, where the drive link and control link are disposed at a predetermined angle giving maximum rotation to shaft 18. This gives extremely fine control over the movement of fountain roller 16.

Having described preferred embodiments of the transmission apparatus of the present invention, it will be appreciated that various modifications may be made to the structures described above. For example, other mechanisms could be used to change the position of the remote or lower distal end of control link 54. Release lever 54 and its associated pivoting block 128 and link 126 could be replaced by some other mechanism for lifting the ductor roller cam follower off its cam. Anti-backlash clutch 98 could be replaced with a simple friction device or perhaps eliminated. The fulcrum stud 140 and bracket 142 for link 126 could be eliminated if a shaft of another roller is available to act as the fulcrum. Other modifications will be readily apparent to those skilled in the art.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the claims herein.

What is claimed is:

1. A transmission apparatus for controlling the rotation of a fountain roller in an offset printing press, the printing press having a housing containing a reciprocating drive and the fountain roller having a shaft extending into the housing, the apparatus comprising:

a mounting plate adapted to be mounted in the printing press housing adjacent to the shaft of the fountain roller;

a one-way rotational clutch adapted to be mounted on the fountain roller shaft;

a crank operably connected to the clutch for rotation of the clutch and thus the shaft;

a drive link pivotally connected to the crank for rotation of the crank upon longitudinal movement of the drive link transversely of the crank, said drive link having a remote distal end adapted to be pivotally coupled to said reciprocating drive; and control means mounted on the mounting plate and adapted to be coupled to the reciprocating drive for controlling the direction of movement of said reciprocating drive relative to the drive link.

2. A transmission apparatus as claimed in claim 1 wherein the control means includes a control link also adapted to be pivotally coupled to said reciprocating drive at the drive link remote distal end, said control link being disposed transversely of the reciprocating drive and also having a remote distal end movably mounted on the mounting plate for controlling the direction of movement of the reciprocating drive.

3. A transmission apparatus as claimed in claim 2 wherein the control means includes a sliding block pivotally coupled to the control link remote distal end, and an adjusting rod mounted on the mounting plate and being connected to the sliding block for positioning same.

4. A transmission apparatus as claimed in claim 2 wherein the control means is a screw mechanism mounted on the mounting plate and having a rotatable, stationary screw and a nut mounted on the screw, the nut being pivotally attached to the control link remote distal end.

5. A transmission apparatus as claimed in claim 1 wherein the one-way rotational clutch is a one-way roller bearing.

6. A transmission apparatus as claimed in claim 2 wherein the control link remote distal end is mounted on the mounting plate for movement from a first position where the drive link and control link are parallel, to a second position wherein the drive link and control link are disposed at a predetermined angle therebetween.

7. A transmission apparatus as claimed in claim 1 and further comprising a floating crank connected to the mounting plate, the floating crank having mounted therein an anti-backlash, one-way, rotational clutch, said anti-backlash clutch having a central opening for the passage of the fountain roller shaft therethrough.

8. A transmission apparatus as claimed in claim 7 wherein the anti-backlash clutch is attached to the mounting plate by being mounted in a floating crank pivotally mounted on the mounting plate.

9. A transmission apparatus as claimed in claim 7 wherein the anti-backlash clutch is a one-way roller bearing.

10. A transmission apparatus as claimed in claim 3 and further comprising an indicator rod attached to the sliding block and extending exteriorly of the housing for indicating the position of the control link and thus the amount of rotation of the fountain roller.

11. A transmission apparatus as claimed in claim 4 and further comprising an indicator rod attached to the nut and extending exteriorly of the housing for indicating the position of the control link and thus the amount of rotation of the fountain roller.

12. A transmission apparatus as claimed in claim 1 and further comprising a release lever pivotally mounted on the mounting block and extending exteriorly of the housing, the release lever having means for preventing the transfer of water from the fountain roller.

13. A transmission apparatus as claimed in claim 12 wherein the transmission apparatus is adapted to be mounted in a printer color head having a ductor roller pivoted by a cam follower, and wherein the release lever includes a link adapted to engage and lift said cam follower off its cam.

14. A transmission apparatus as claimed in claim 1 wherein the mounting plate defines a central, elongate opening for the fountain roller shaft to pass therethrough, and wherein the mounting plate defines at least one mounting hole located therein to register with an existing threaded hole in the housing.

* * * * *